US007716751B2

(12) United States Patent
Cook et al.

(10) Patent No.: US 7,716,751 B2
(45) Date of Patent: May 18, 2010

(54) INSULATED AND MOISTURE RESISTANT GLOVE FOR HOLDING BEVERAGE CONTAINERS

(76) Inventors: Kimberly Ann Cook, 3750 N. New England, Chicago, IL (US) 60634; Wayne Arthur Crawford, 3340 N. Osage Ave., Chicago, IL (US) 60634

( * ) Notice: Subject to any disclaimer, the term of this patent is extended or adjusted under 35 U.S.C. 154(b) by 808 days.

(21) Appl. No.: 11/095,118

(22) Filed: Mar. 31, 2005

(65) Prior Publication Data

US 2006/0143785 A1 Jul. 6, 2006

Related U.S. Application Data

(60) Provisional application No. 60/640,689, filed on Dec. 30, 2004.

(51) Int. Cl.
*A41D 19/00* (2006.01)

(52) U.S. Cl. ..... 2/160; 2/163

(58) Field of Classification Search ..... 2/159, 2/158, 160

See application file for complete search history.

(56) References Cited

U.S. PATENT DOCUMENTS 2,083,935 A * 6/1937 Arnold ..... 2/161.6
2,148,849 A * 2/1939 Blewer ..... 2/159
2,380,633 A * 7/1945 Daiber ..... 2/158
2,735,108 A 2/1956 Cremer
2,810,131 A 10/1957 Kogut
2,889,556 A 6/1959 Mehler
2,905,946 A 9/1959 Goldsmith
3,096,523 A * 7/1963 Bruchas ..... 2/159
4,628,544 A 12/1986 Erickson
5,316,294 A * 5/1994 Turangan ..... 473/573
5,369,257 A * 11/1994 Gibbon ..... 219/759
5,752,278 A * 5/1998 Gunn ..... 2/69
5,829,057 A * 11/1998 Gunn ..... 2/69
5,878,439 A 3/1999 Waters, Jr.
5,956,770 A * 9/1999 Dennis ..... 2/160
6,099,936 A * 8/2000 Kashihara ..... 428/141
6,279,165 B1 * 8/2001 Kobayashi ..... 2/163
6,298,488 B1 10/2001 Duncan et al.
6,427,247 B1 * 8/2002 Suk ..... 2/161.2
6,427,250 B1 * 8/2002 Stull et al. ..... 2/161.6
6,658,668 B2 * 12/2003 Newcomb ..... 2/160

* cited by examiner

*Primary Examiner*—Gary L Welch
*Assistant Examiner*—Richale L Quinn
(74) *Attorney, Agent, or Firm*—McAndrews, Held & Malloy, Ltd.

(57) ABSTRACT

An glove that has one or more pads that insulate and resist moisture for holding beverage containers. The pad or pads are positioned at the surface of the glove that contacts a beverage container when a wearer of the glove grasps the container. The pads provide an enhanced grip and comfort for the wearer's hand when holding a beverage container.

15 Claims, 3 Drawing Sheets

FIG. 1
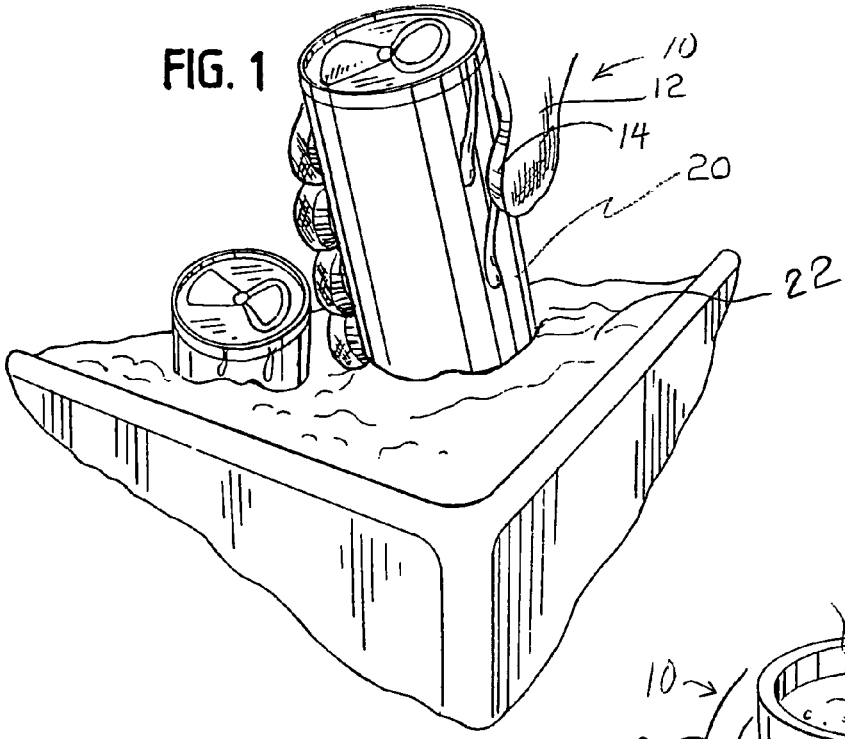
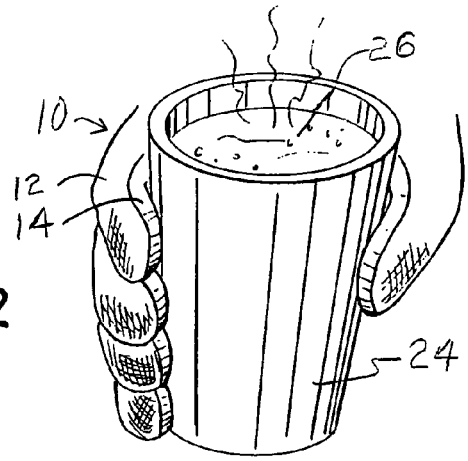
FIG. 2
FIG. 3
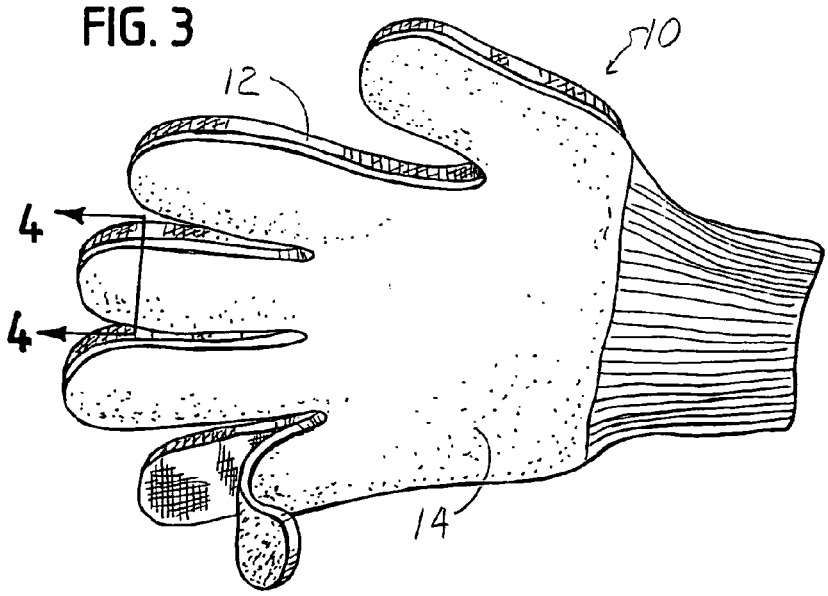
FIG. 4
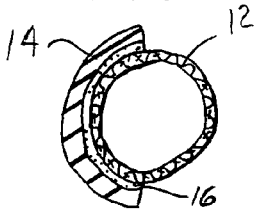

INSULATED AND MOISTURE RESISTANT GLOVE FOR HOLDING BEVERAGE CONTAINERS

RELATED APPLICATIONS

Priority is claimed from provisional application U.S. Ser. No. 60/640,689, filed Dec. 30, 2004. The entire specification and all the claims of the provisional application referred to above are hereby incorporated by reference to provide continuity of disclosure.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Beverages are commonly consumed at outdoor events including parties, picnics and sporting events. Containers from which beverages are consumed outdoors include mugs, glasses, bottles, and cans. Beverages, and frequently the containers from which they are consumed, are generally either chilled or heated. Frequently, the temperature of a beverage is inversely related to the outside temperature, cold drinks being favored when it is warm and hot or warm drinks being preferred when it is cold. However, though perhaps less common cold drinks are often consumed outdoors in cold weather and hot drinks are consumed in warm weather.

It is preferable that beverages maintain their temperature while they are held and being consumed. Different beverage containers have different abilities to maintain the temperature of beverages. Insulating containers or holders that help maintain a beverage's temperature are used for outdoor consumption of beverages. Examples of insulting containers include insulated mugs and insulating sleeves for cans. Cans and bottles, which function through most of their use to hold a beverage for shipping and storing rather than while the beverage is consumed, are generally less effective at maintaining the temperature of the held beverage when held than are containers that are made to hold a beverage while it is consumed. A person's hand can heat a chilled beverage through bottles and particularly through cans. This is generally recognized to be a warm weather problem. In cold weather, rather than concern for heating the beverage, a person who consumes a chilled beverage from a bottle or can may be concerned that the chilled container makes the hand holding the container cold and uncomfortable.

In addition to maintaining the temperature of a beverage, consuming beverages outdoors raises concerns related to maintaining a grip on a beverage container. Avoiding dropping a container and spilling a beverage is desirable for many reasons. Dropping a container can create a hazard by breaking a container. Maintaining a grip on a beverage container is a particular concern for cans and bottles that are primarily containers for transporting beverages because they are not made to be held while the beverage is consumed as are mugs, cups or glasses. Maintaining a grip on bottles or cans is a particular concern when those containers have been stored with ice to be kept cold and as a result are wet, slippery and difficult to hold.

When beverages are consumed outside in cold temperatures, people often wear gloves or mittens to both protect their hand from weather and from contact with a beverage. Gloves can decrease the wearer's ability to feel the container and may make the wearer's grip on the container less certain. Such difficulty in holding a beverage container is increased when beverages in cans or bottles are wet either from rain or snow or from being kept on ice.

A need exists for a product that will allow a person to hold a beverage without heating a chilled beverage or being heated by a hot beverage. In addition, a need exists for a product that will help a person grip a beverage container particularly when the container is damp or wet.

BRIEF SUMMARY OF THE INVENTION

In accordance with the present invention, a glove is provided that will protect a wearer's hand, that will limit heating a chilled beverage in a held container from a wearer's hand, will limit heating of a wearer's hand by a container holding a hot beverage and that increases the wearer's ability to grip a beverage container, particularly when the container is damp or wet. A glove according to the present invention includes pads positioned at the gripping surface of the glove that provide insulation between the container and the wearer's hand. The pads of a glove according to the present invention may also provide enhanced gripping of a held container.

BRIEF DESCRIPTION OF SEVERAL VIEWS OF THE DRAWINGS

FIG. 1 is an isometric view of a hand wearing a glove according to the present invention grasping a chilled and wet beverage can.

FIG. 2 is an isometric view of a hand wearing the glove shown by FIG. 1 grasping a cup holding a hot beverage.

FIG. 3 is a view of the palm side of the glove shown by FIG. 1 having a portion of a pad peeled from the finger of the glove.

FIG. 4 is a cross section of a finger of the glove shown by FIG. 3.

DETAILED DESCRIPTION OF THE INVENTION

Figure 6:
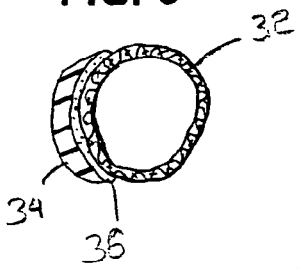
FIG. 6 is a cross section of a finger of the glove shown by FIG. 5.

FIG. 1 shows a person's hand wearing a glove 10 according to the present invention grasping a chilled beverage can 20 that was surrounded by a mixture of ice and water 22. The glove 10 is includes a fabric glove 12 that substantially encases a wearer's hand and a gripping pad 14 affixed to the glove 10 at the grasping surface of the wearer's hand including at the fingers as shown. FIG. 2 shows the glove shown by FIG. 1 worn while gripping a cup 24 containing a hot liquid 26.

FIG. 3 shows the palm side of the glove 10 including the pad 14. The pad 14 is positioned at the grasping surface on the palm side of the glove 10. The pad 14 is sized and positioned on the glove 10 to separate a wearer's hand from a beverage container that is held by a wearer of the glove 10 and to separate portions of the glove 10 other than the pad 14, including the fabric glove 12, from a held beverage container.

The pad 14 is made of neoprene to provide a moisture resistant and insulating material on the grasping surface of the glove 10 and to provide a surface that readily grips beverage containers. Among the properties of neoprene that provide an appropriate pad in accordance with the invention are flexibility that permits comfortable grasping of beverage container, resistance to absorbing moisture, and providing a frictional contact with materials that commonly form beverage containers. Textured plain neoprene that is 3 millimeters thick has been found to be sufficiently flexible for use as a pad, provides an enhanced grasp of wet cans and bottles holding beverages, and provides sufficient insulation between a wearer's hand and a beverage container to permit a wearer of the glove to hold a chilled can or bottle and to hold a cup or mug that contains a hot beverage.

FIG. 4 shows a cross section of a finger portion of the glove shown by FIG. 3. The neoprene pad 14 is secured to the fabric glove 12 by an adhesive 16 interposed between the pad 14 and the glove 12. The neoprene pad 14 may alternatively or additionally be attached to the glove by being sown to the glove. Nylon Tex70 thread may be used for sewing the neoprene pad 14.

Figure 5:
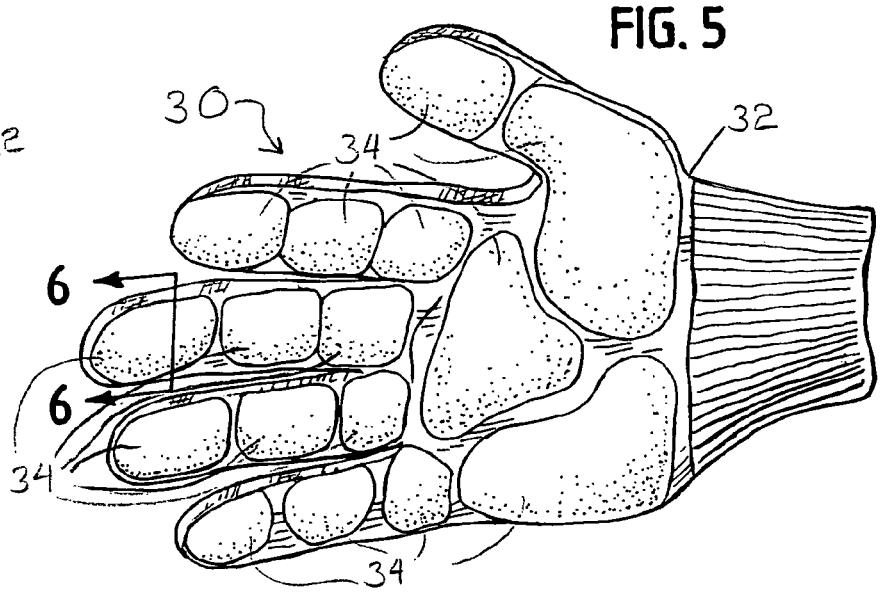
FIG. 5 is a view of the palm side of a glove according to the present invention having a multiple separated pads.

FIG. 5 shows a glove 30 having multiple separated pads 34 secured to a fabric glove 32. The pads 34 are sized and positioned on the grasping surfaces of a wearer's hand, including the palm and fingers, so that a pad 34 is positioned at each location at which the glove 30 will contact a beverage container that is held by the hand of a wearer of glove 30. In addition to the functional requirements that pads 34 be sized and positioned to contact a held beverage container at each location that a wearer's hand will cause the glove 30 to contact a held beverage container, the pads 34 may additionally be sized and configured to provide a desired appearance including spelling words or forming a logo or other desired design.

FIG. 6 shows a cross section of a finger portion of the glove shown by FIG. 5. Similar to the construction shown by FIG. 4, the neoprene pad 34 is secured to the fabric glove 32 by an adhesive 36 interposed between the pad 34 and the glove 32. Comparison of the pad 34 shown by FIG. 6 to the pad 14 shown by FIG. 4 shows the differences in the configurations of those pads. The pad 34 does not extend circumferentially as far around the finger of the glove 32 as does the pad 14 around the finger of the glove 12. However, the pad 34 is sized and positioned to encompass the extent of contact of the finger of the glove 32 with a held beverage container.

Figure 7:
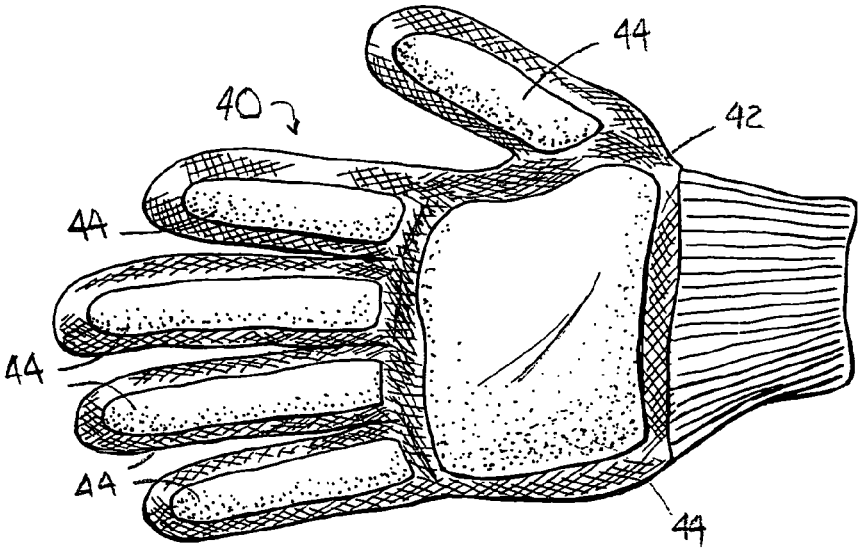
FIG. 7 is a view of the palm side of a glove according to the present invention having another configuration of multiple separated pads.

FIG. 7 shows a glove 40 having an alternative configuration of multiple separated pads 44 secured to a fabric glove 42. A pad 44 is positioned on the grasping surface of each finger of the glove 40 to extend along the finger from a location near the palm to a location near the distal extent of the finger. A pad 44 is also positioned on the palm surface of the glove 40. The pads 44 are sized and positioned to encompass each location at which the glove 40 will contact a beverage container that is held by the hand of a wearer of glove 40.

Figure 8:
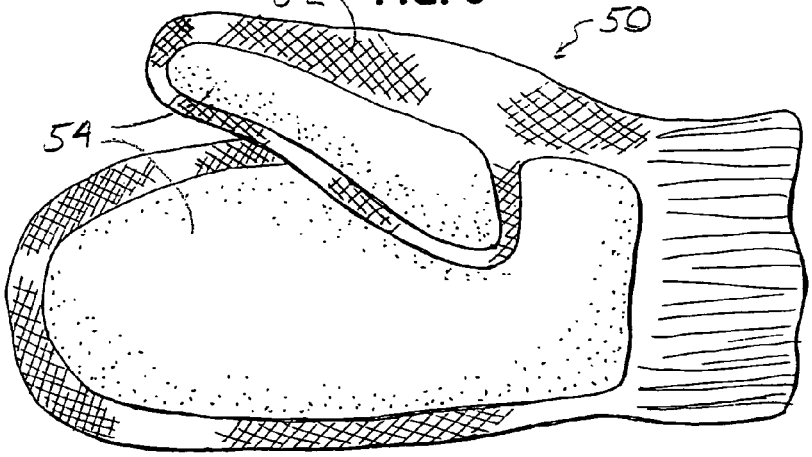
FIG. 8 is a view of the palm side of a mitten-type glove according to the present invention having multiple separated pads.
Figure 9:
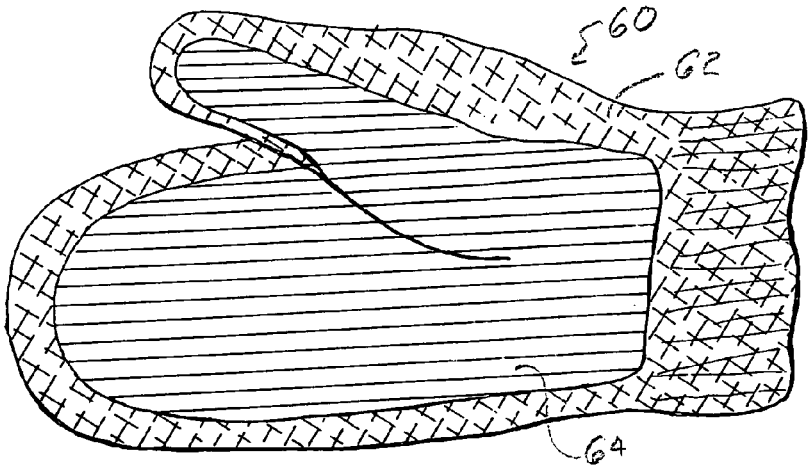
FIG. 9 is a view of the palm side of a mitten-type glove according to the present invention having a pad at the gripping surface of the mitten.
Figure 10:
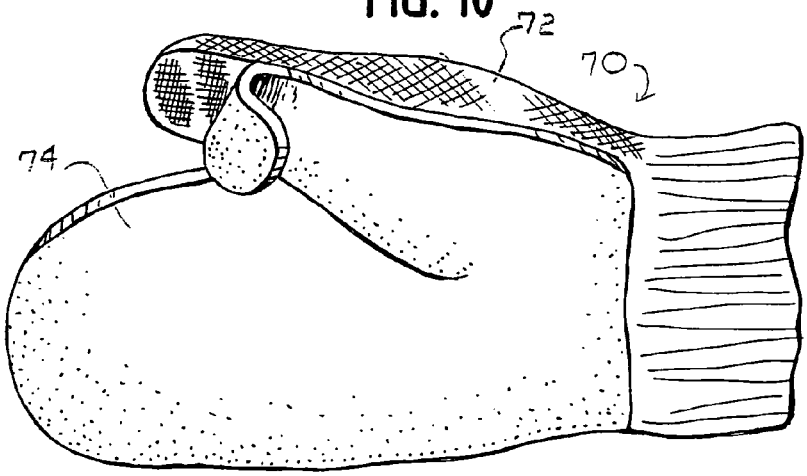
FIG. 10 is a view of the palm side of a mitten-type glove according to the present invention having a different configuration pad at the gripping surface of the mitten.

FIGS. 8, 9, and 10 illustrate contemplated alternative embodiments of the invention that are alternatives to gloves having individual fingers as shown by FIGS. 1, 2, 3, 5 and 7. The gloves shown by FIGS. 8, 9, and 10 are formed as mitten. FIG. 8 shows a glove mitten type glove 50 having separated pads 54 affixed to a fabric mitten 52. One pad 54 is positioned on the gripping surface of the thumb and one on the palm and extending over the gripping surfaces of the fingers other than the thumb. FIG. 9 shows a mitten type glove 60 having a single pad 64 affixed to a woven mitten type glove 62. The pad 64 is positioned on the grasping surface of the glove 60 and extends over the palm surface and from the palm surface onto the thumb and over the gripping surfaces of the other fingers. FIG. 10 shows a mitten type glove 70 having a single pad 74 affixed to a fabric mitten type glove 72. The pad 74 is positioned on the grasping surface of the glove 70 and extends over the palm surface and from the palm surface onto the thumb and over the gripping surfaces of the other fingers. Comparison of the mitten type gloves 60 an d70 shows that the pads of those gloves, 64 and 74 respectively, cover different amounts of the grasping surfaces. Again, both pads 64 and 74 are sized and positioned to contact a held beverage container at every location that the glove 60 and 70 contact the container when a wearer of those gloves grasps the container with the hand that is wearing those gloves.

It is also contemplated that the pads that form part of the invention may be made of material other than neoprene. A pad used with a glove in accordance with the invention insulates the held beverage from a wearer's hand sufficiently to prevent undue heating of a held beverage by the wearer's hand and to avoid uncomfortable heating of the wearer's hand by a hot beverage container. A pad used with a glove in accordance with the invention is sufficiently flexible to allow a wearer to maintain a comfortable and secure grip of a beverage container. Flexibility may be the result of the pad material, thickness, or pad size and configuration, larger pads requiring greater flexibility than smaller pads. When the material forming the remainder of the glove has appropriate properties, pads may also be formed by that same material by additional thickness or other enhancement that provides pads with appropriate properties.

The present invention has been described by reference to specific embodiments of the invention. It will be appreciated by those skilled in the art that the invention may be practiced other than as described. For example, and without limitation, other configurations of gloves and pads may be used, and the materials of which the gloves and pads are made may differ from the described embodiments. Therefore, the invention not be limited to the particular embodiments disclosed. What is sought to be protected is all embodiments falling within the scope of the appended claims.

The invention claimed is:

1. A glove for holding a beverage container comprising:

a glove made of a glove material that is sized and configured to extend at least over the palm and grasping surfaces of fingers of a wearer's hand; and a pad that is made of a pad material, the pad is sized and positioned on an outer surface of the glove to be adjacent to at least a portion of the palm and at least a portion of the grasping surface of each finger of the wearer's hand and to prevent the glove from contacting the held beverage container, flexibly conforms to the held beverage container, insulates the wearer's hand from the held beverage container to permit comfortable holding of the beverage container containing chilled and hot beverages, resists moisture passing through the pad, and provides an enhanced grip of the beverage container held by the wearer's hand wherein pad material is a different material than glove material, wherein the pad material is textured neoprene, and wherein the pad continuously extends over at least substantially the entire grasping surface of the palm and from the palm adjacent at least substantially the entire length of the finger.

2. The glove of claim 1 wherein the glove is a mitten-type glove.

3. The glove of claim 2 wherein the pad material is different than the glove material and the pad material is neoprene.

4. The glove of claim 3 wherein the pad material is textured neoprene.

5. The glove of claim 1 wherein the glove is configured to have a thumb portion that at least partially surrounds a thumb of the wearer's hand and a plurality of finger portions, each finger portion configured to at least partially surround a wearer's finger.

6. The glove of claim 5 wherein the pad material is different than the glove material and the pad material is neoprene.

7. The glove of claim 6 wherein the pad material is textured neoprene.

8. The glove of claim 7 wherein the pad is not more than approximately 3 mm thick.

9. A glove for holding a beverage container comprising:

a glove made of a glove material that is sized and configured to extend at least over the palm and grasping surfaces of fingers of a wearer's hand; and a plurality of pads made of a pad material, the plurality of pads are sized and positioned on an outer surface of the glove to be adjacent to at least a portion of the palm and at least a portion of the grasping surface of each finger of the wearer's hand so that the plurality of pads collectively prevent the wearer's hand and the glove from contacting the beverage container, flexibly conform to the held beverage container, insulate the wearer's hand from the held beverage container to permit comfortable holding of the beverage container containing chilled and hot beverages, resist moisture passing through the pad, and provide an enhanced grip the beverage container held by the wearer's hand wherein the glove is configured to have a thumb portion that at least partially surrounds a thumb of the wearer's hand and a plurality of finger portions, each finger portion configured to at least partially surround a wearer's finger, wherein the pad material is different than the glove material and the pad material is neoprene, wherein the plurality of pads continuously extend over at least substantially the entire grasping surface of the palm and adjacent at least substantially the entire length of each finger.

10. The glove of claim 9 wherein the glove is a mitten-type glove.

11. The glove of claim 9 wherein the pad material is a different material than the glove material.

12. The glove of claim 10 wherein the pad material is different than the glove material and the pad material is neoprene.

13. The glove of claim 12 wherein the pad material is textured neoprene.

14. The glove of claim 13 wherein the pads are not more than approximately 3 mm thick.

15. The glove of claim 9 wherein the pad material is textured neoprene and wherein the pads are not more than approximately 3 mm thick.

* * * * *